US007140808B2

(12) United States Patent
Raspotnik

(10) Patent No.: US 7,140,808 B2
(45) Date of Patent: Nov. 28, 2006

(54) CATWALK DEVICE AND METHOD

(76) Inventor: John Raspotnik, 403 11th St., E. Ashland, WI (US) 54806

( * ) Notice: Subject to any disclaimer, the term of this patent is extended or adjusted under 35 U.S.C. 154(b) by 0 days.

(21) Appl. No.: 11/137,130

(22) Filed: May 25, 2005

(65) Prior Publication Data

US 2005/0276668 A1 Dec. 15, 2005

Related U.S. Application Data

(60) Provisional application No. 60/574,141, filed on May 25, 2004.

(51) Int. Cl.
*E02D 17/00* (2006.01)

(52) U.S. Cl. ..... 405/282; 405/283; 405/272; 405/274; 182/112; 182/115; 182/109

(58) Field of Classification Search ..... 405/282, 405/283, 272, 274, 157; 182/112, 115, 116, 182/87, 109, 82–85
See application file for complete search history.

(56) References Cited

U.S. PATENT DOCUMENTS 4,253,547 A * 3/1981 Skaalen et al. ..... 182/115
4,825,976 A * 5/1989 Wyse ..... 182/119
5,865,567 A * 2/1999 Wilkinson ..... 405/283
6,907,957 B1 * 6/2005 Couch ..... 405/283
2004/0247398 A1 * 12/2004 Lane et al. ..... 405/283

FOREIGN PATENT DOCUMENTS

DE 24 55 940 * 8/1976
GB 2353557 * 2/2001

* cited by examiner

*Primary Examiner*—Frederick L. Lagman
(74) *Attorney, Agent, or Firm*—Schewgman, Lundberg, Woessner & Kluth

(57) ABSTRACT

A catwalk is provided for use in trenching operations that provides increased safety and improves efficiency. Methods are also provided that save time over the prior process of building multiple land bridges. Selected features include reduction in the number of ladders used increases worker safety, along with several other safety features such as catwalk railings, holding devices for ladders, etc. One catwalk is shown with a skid assembly to further increases efficiency by allowing the trench box to be towed with the catwalk in place.

11 Claims, 6 Drawing Sheets

CATWALK DEVICE AND METHOD

RELATED APPLICATION

This application claims benefit under 35 U.S.C. 119(e) of U.S. Provisional Application Ser. No. 60/574,141, filed May 25, 2004, which is incorporated herein by reference.

TECHNICAL FIELD

This invention relates to walkways that allow access from one location to another. Specifically, this invention relates to catwalks from an edge of a trench to a side of a trench box.

BACKGROUND

FIG. 1 shows a common trench 100. Trenches are used for a variety of purposes such as utility installation. Some examples of utilities include, but are not limited to, sanitary sewer, storm sewer, water supply, gas, electric, etc. A trench box 110 is commonly used when constructing trenches 100 to keep the sides of the trench 100 from caving in during construction.

During construction, workers must move in and out of the trench 100. Currently, workers construct a land bridge 120 from dirt and lower a first ladder 130 to the land bridge 120. A worker must go down the first ladder 130 to the land bridge 120 in order to cross from the edge 102 of the trench 100 to an edge 112 of the trench box 110. Then the worker must use a second ladder (not shown) to get from the edge 112, into the trench box 110. As digging of the trench 100 progresses, the trench box 110 must be moved, and a new land bridge 120 must be constructed for each move of the trench box 110.

What is needed is an improved device and method to increase efficiency and safety during trenching operations.

DETAILED DESCRIPTION

Figure 1:
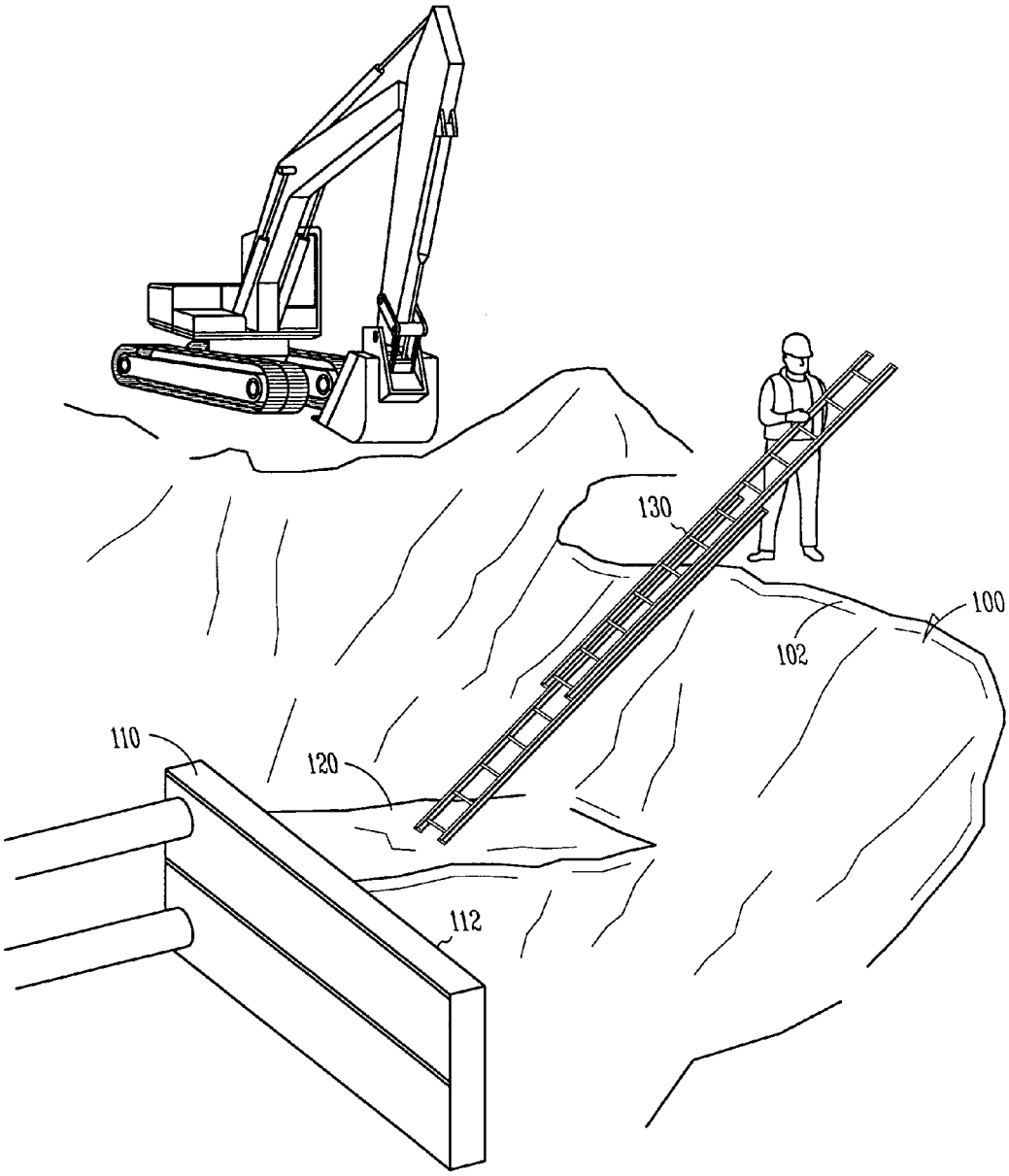
FIG. 1 (PRIOR ART)
FIG. 1 shows a trench box and trench according to the prior art.

In the following detailed description, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, or logical changes, etc. may be made without departing from the scope of the present invention.

Figure 2:
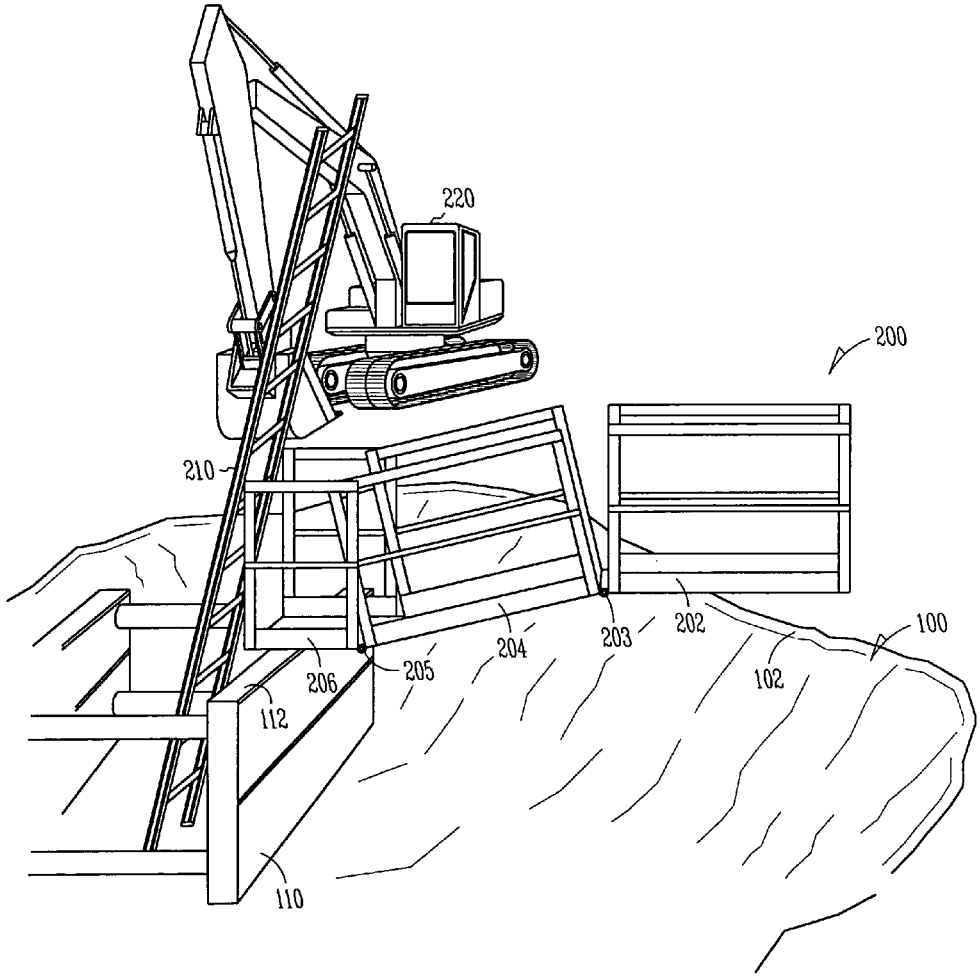
FIG. 2 shows a configuration of a catwalk according to an embodiment of the invention.

FIG. 2 shows a catwalk 200 that bridges a gap between an edge 102 of a trench 100 and an edge 112 of a trench box 110. In one embodiment, the catwalk 200 includes multiple sections. In one embodiment, the multiple sections are hinged together to accommodate multiple possible trench configurations. FIG. 2 shows a first section 202 and a second section 204 with a hinge joint 203 between them. A third section 206 is further shown with a hinge 205 between the second section 204 and the third section 206. In one embodiment, each section of the catwalk 200 includes hand rails. In one embodiment, the catwalk is fabricated from welded steel, although the invention is not so limited. Other configurations include alternate materials such as aluminum, wood, polymers, etc. Other fabrication techniques, apart from welding, include fasteners such as screws, adhesive assembly, pressure fits, etc. Although three sections are shown in FIG. 2, other configurations include fewer sections, or more sections depending on factors such as the trench configuration, the job site, etc.

A ladder 210 is shown in FIG. 2 to enter the trench box 110 from the catwalk 200. It should be noted that with the configuration shown in FIG. 2, only one ladder is needed to enter the trench box 110. A digger such as a backhoe 220 is further shown for digging the trench 100. In one embodiment, the backhoe 220 is further used to pull the trench box 110 back as the trench progresses.

Figure 3:
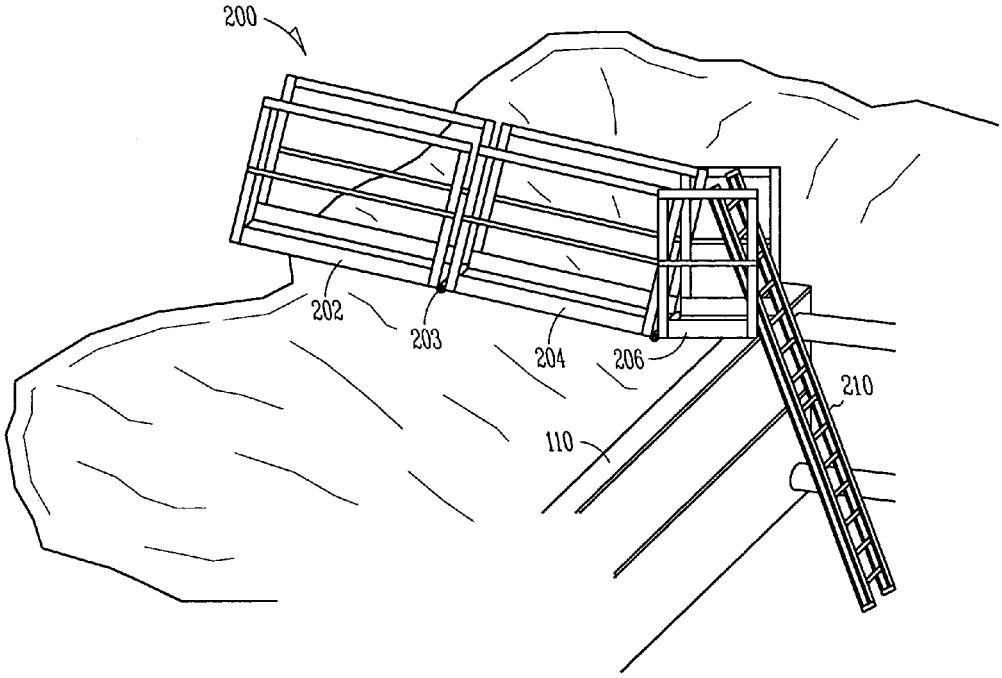
FIG. 3 shows another configuration of a catwalk according to an embodiment of the invention.

FIG. 3 shows the catwalk 200 in position along a trench 100 with a different profile from FIG. 1. The catwalk 200 in FIG. 2 shows the pivot 203 rotated to where the first section 202 and the second section 204 but up against each other, creating a continuous flat walking surface between then first section 202 and the second section 204.

Figure 4:
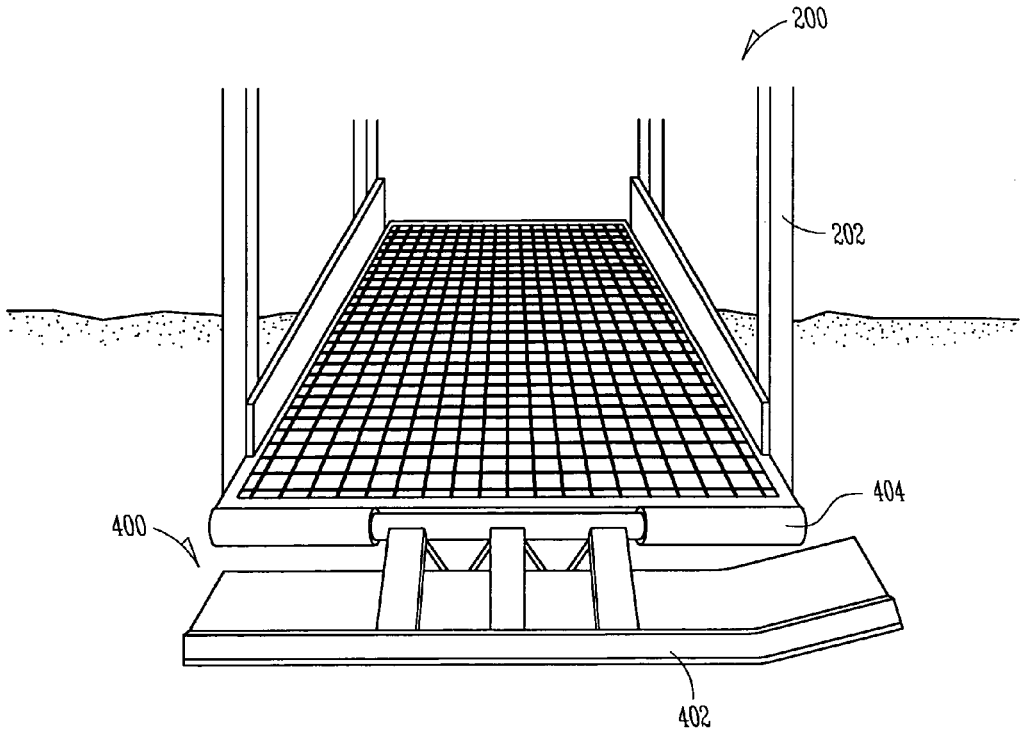
FIG. 4 shows an end view of a catwalk according to an embodiment of the invention.

FIG. 4 shows a portion of the first section 202 located on the edge of the trench. In one embodiment, a skid assembly 400 is included in the catwalk 200. In one embodiment, the skid assembly 400 includes a sliding portion 402 and a hinge 404. In one method of operation, the skid assembly 400 allows the catwalk to slide along the edge of the trench as the trench box is pulled. As discussed above, in one embodiment, the trench box is pulled along by a digging device such as a backhoe as digging of the trench progresses. One advantage of a skid assembly includes efficiency and speed of a trenching operation. In contrast to the configuration described in FIG. 1, after moving the trench box, there is no need to construct a new land bridge for entry and exit from the trench box.

Figure 5:
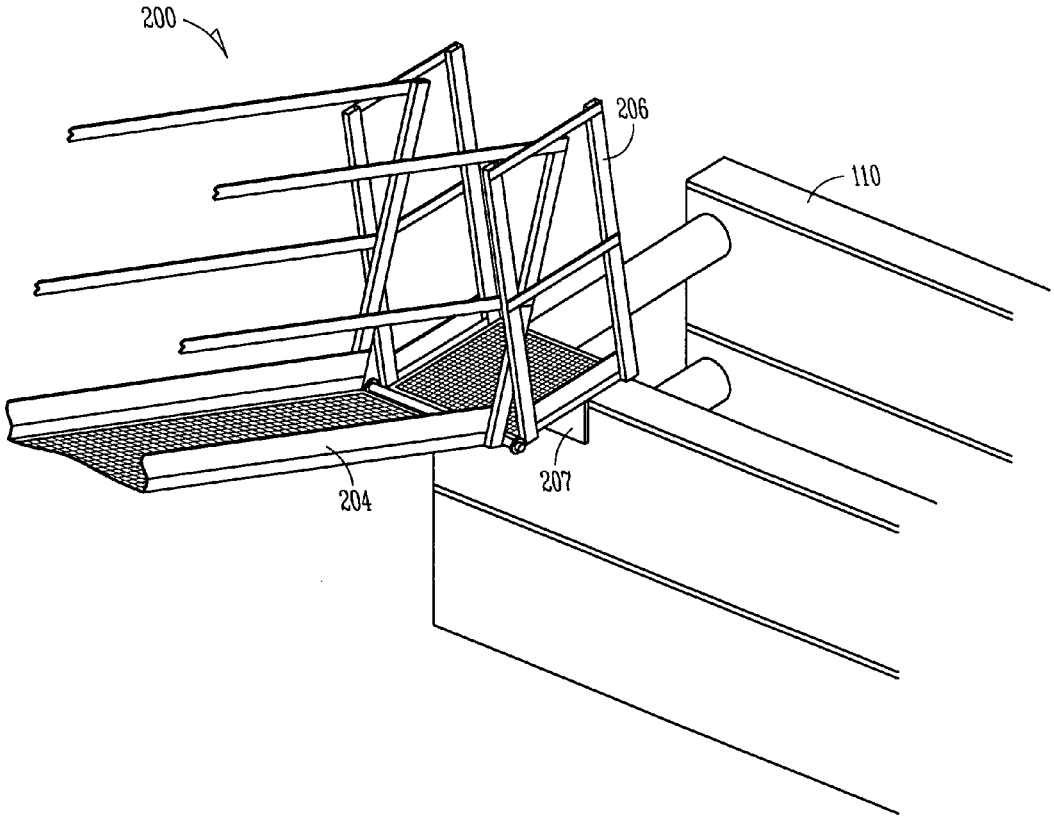
FIG. 5 shows a detail view of a catwalk according to an embodiment of the invention.

FIG. 5 shows the third section 206 of the catwalk 200 in closer detail as it is attached to the trench box 110. In one embodiment, a fitting 207 such as a pair of metal protrusions line up with a side of the trench box 110. The fitting 207 holds the end of the catwalk onto the trench box 110 for safety, and to keep the catwalk from falling off the trench box 110 during a moving operation as the trench progresses. In one embodiment, the fitting 207 includes a mating feature welded to the trench box 110 where the catwalk 200 includes an engaging feature that is adapted to mate with the mating feature on the trench box. In one embodiment, the mating feature includes at least one section of a metal cylinder that can be pinned to the catwalk.

The hinge between the second section 204 and the third section 206 has an added advantage in that the first and second sections 202, 204 can be folded up on top of the third section 206 for selected moving of the trench box 110. In one method, an obstacle such as a tree or power pole prevents the catwalk from remaining extended during a move of the trench box 110. In such a situation, multiple sections of the catwalk can be folded up until the obstacle is passed.

Figure 6:
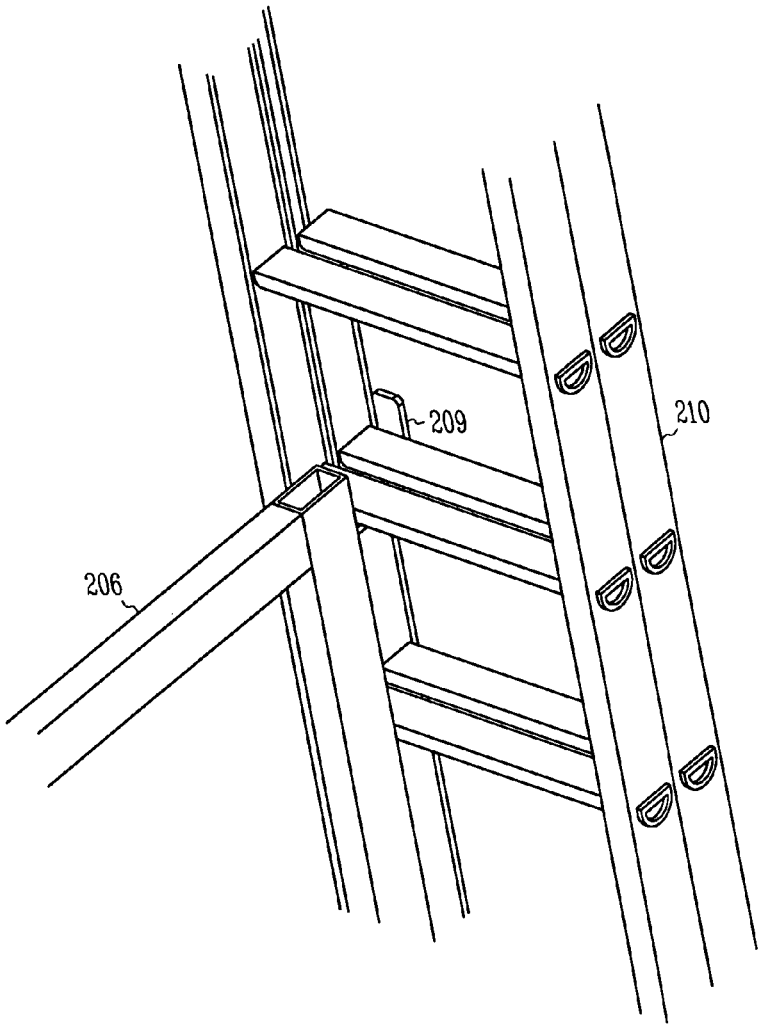
FIG. 6 shows another detail view of a catwalk according to an embodiment of the invention.

FIG. 6 shows a detail of a portion of the third section 206 of the catwalk 200. In one embodiment, a holding device 209 such as a hook, clamp, etc. is included on the catwalk

200. The holding device 209 can be used to hold a ladder 210. One advantage of the holding device 209 includes safety to prevent the ladder 210 from falling into the trench box. Another advantage of the holding device includes the ability to store items such as a ladder 210 or a shovel during a moving operation of the trench box. Although one holding device 209 is shown in FIG. 6, multiple holding devices are included in other embodiments, for example to hold both a shovel and a ladder.

CONCLUSION

Thus has been shown, a catwalk for use in trenching operations that provides increased safety and improves efficiency. The use of a catwalk saves time over the prior process of building multiple land bridges. A reduction in the number of ladders used increases worker safety, along with several other safety features such as catwalk railings, holding devices for ladders, etc. The use of a skid assembly further increases efficiency by allowing the trench box to be towed with the catwalk in place.

While a number of advantages of embodiments described herein are listed above, the list is not exhaustive. Other advantages of embodiments described above will be apparent to one of ordinary skill in the art, having read the present disclosure. Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used.

I claim:

1. A catwalk, comprising:

a first end for attachment to a trench box;

a second end for placement on an edge of a trench;

a ground engaging device coupled to the second end of the catwalk, wherein motion of the trench box is permitted with the catwalk in place; and wherein the catwalk provides safe user access between the edge of the trench and the trench box for a range of trench widths.

2. The catwalk of claim 1, wherein the catwalk is formed from a number of jointed sections.

3. The catwalk of claim 1, wherein the ground engaging device includes a skid assembly.

4. The catwalk of claim 1, wherein the ground engaging device includes a wheel assembly.

5. The catwalk of claim 1, further including a holder for a ladder.

6. A method of digging a trench, comprising:

digging a section of a trench in front of a trench box;

moving the trench box into the section of trench in front of the trench box;

coupling a first end of the catwalk directly to an edge of the trench box;

locating a second end of the catwalk on an edge of the trench to provide safe user access between the edge of the trench and the trench box for a range of trench widths; and moving the catwalk along with the trench box wherein the catwalk remains attached to the trench box during the moving operation.

7. The method of claim 6, further including folding up a hinged section of the catwalk to avoid an obstacle on a side of the trench, and folding the hinged section back down once the obstacle is passed.

8. The method of claim 6, further including adding or subtracting catwalk sections to accommodate a distance between the edge of the trench box and the edge of the trench.

9. The catwalk of claim 8, further including a holder for a ladder.

10. The catwalk of claim 8, wherein the catwalk is formed from a number of jointed sections.

11. A catwalk, comprising:

a first end for attachment to a trench box;

a second end for placement on an edge of a trench; and a ground engaging device coupled to the second end of the catwalk, wherein motion of the trench box is permitted with the catwalk in place;

wherein the ground engaging device includes a skid assembly.

* * * * *